United States Patent [19]

Nakajima et al.

[11] Patent Number: 4,861,235

[45] Date of Patent: Aug. 29, 1989

[54] VARIABLE CAPACITY TYPE COMPRESSOR

[75] Inventors: Nobuyuki Nakajima; Kenichi Inomata; Masaya Moruta; Kazuo Eitai; Toshio Yamaguchi, all of Konan, Japan

[73] Assignee: Diesel Kiki Co., Ltd., Tokyo, Japan

[21] Appl. No.: 309,618

[22] Filed: Feb. 10, 1989

[30] Foreign Application Priority Data

Apr. 12, 1988 [JP] Japan ..... 63-89676

[51] Int. Cl.[4] ..... F04B 49/00; F04C 29/08

[52] U.S. Cl. ..... 417/295; 417/310

[58] Field of Search ..... 417/295, 310

[56] References Cited

U.S. PATENT DOCUMENTS 4,778,352 10/1988 Nakajima ..... 417/295

*Primary Examiner*—William L. Freeh

*Attorney, Agent, or Firm*—Frishauf, Holtz, Goodman & Woodward

[57] ABSTRACT

A variable capacity type compressor in which a control element is mounted in one of side blocks formed with inlet ports for rotation about its own axis in opposite circumferential directions between a first extreme position providing the maximum capacity of the compressor, and a second extreme position providing the minimum capacity of the compressor, to vary the compression starting timing. The control element has cut-out portions through which compression medium is drawn into compression spaces, of which one upstream end with respect to the direction of rotor rotation determines the compression starting timing in cooperation with vanes passing same. The cut-out portion is formed of first and second portions circumferentially arranged. At least one recess is formed in an end face of the cam ring facing the control element, which opens in the camming inner peripheral surface thereof and circumferentially extends from a circumferential location at which a suction stroke is started in a compression space within the cylinder or from a point proximate thereto, toward a downstream side with respect to the direction of rotor rotation. The recess is disposed such that when the control element is in the second extreme position, the recess has a downstream end thereof with respect to the direction of rotor rotation positioned downstream of another end of the cut-out portion. The cut-out portion may further be formed with a third portion circumferentially extending continuously from the second portion toward an upstream side with respect to the direction of rotor rotation.

5 Claims, 8 Drawing Sheets

VARIABLE CAPACITY TYPE COMPRESSOR

BACKGROUND OF THE INVENTION

This invention relates to a variable capacity type compressor which is adapted to vary its capacity by changing the compressor starting timing, and more particularly to a variable capacity type compressor which has reduced resistance against the rotation of the rotor at partial capacity operation.

Conventionally, variable capacity type compressors for use in air conditioning systems have been proposed by U.S. Pat. Nos. 4,813,854 and 4,815,945.

These proposed compressors are both constructed such that a control plate member (control element) is disposed for rotation about an axis thereof in opposite directions, which has an outer peripheral edge thereof formed with at least one cut-out portion through which part of refrigerant gas drawn into the cylinder through the inlet port is allowed to leak into a zone under lower pressure, whereby as the control plate member is rotated, the compression starting timing is varied to vary the delivery quantity or capacity. The cut-out portion of the control plate member comprises first and second portions with different depths, the second portion with the smaller depth being disposed such that its upstream end with respect to the direction of rotation of the rotor is positioned upstream of an upstream end of the inlet port when the control plate member is circumferentially displaced to an extreme position in which the minimum capacity of the compressor is obtained, to thereby eliminate unnecessary compression and hence resistance of the compressed gas to the rotation of the rotor, which would be caused if the cut-out portion has the same depth along its whole length as in a conventional variable capacity type compressor during minimum capacity operation.

More specifically, as shown in FIGS. 1 and 2, the proposed compressors each comprise a cylinder formed by a cam ring 100 with an oblong camming inner peripheral surface 100*a*, and a pair of side blocks, not shown, closing opposite ends of the cam ring 100, a rotor 101 rotatably received within the cylinder, a pair of compression spaces 102 defined between the cylinder and the rotor 101, vanes $\mathbf{103}_1$–$\mathbf{103}_5$ radially movably carried by the rotor 101, and a control plate member 105 fitted in an annular recess 104 formed in an end face of one of the side blocks facing the rotor 101 for rotation about its own axis between a full capacity extreme position and a minimum capacity extreme position to vary the compression starting timing. The control plate member 15 has its outer peripheral edge formed with two cut-out portions 107 circumferentially extending at diametrically opposite locations through which refrigerant gas is drawn into the compression spaces 102 through respective inlet ports 106 formed in the one side block, over the entire rotatable angle range of the control plate member 105. Each cut-out portion 107, of which a downstream end 107*a* with respect to the direction of rotation of the rotor determines the compression starting timing, comprises a first portion $\mathbf{107}_1$ extending from the downstream end 107*a* and terminating at a circumferentially intermediate point of the cut-out portion 107 and being almost flush with the outer peripheral surface of the rotor 101, and a second portion $\mathbf{107}_2$ extending continuously from the first portion $\mathbf{107}_1$ to an upstream end 107*b* with respect to the direction of rotation of the rotor and being located radially outwardly of the outer peripheral surface of the rotor 101 by a predetermined amount.

However, according to these compressors, when the control plate member 105 is in the minimum capacity extreme position or in the vicinity thereof, refrigerant is allowed to flow into a compression chamber A defined between vanes $\mathbf{103}_2$ and $\mathbf{103}_3$ which has started a suction stroke from a immediately preceding compression chamber B defined between vanes $\mathbf{103}_1$ and $\mathbf{103}_2$ along one lateral side wall of the vane $\mathbf{103}_2$ and then through a small gap X (hatched in FIG. 3) defined between the vane $\mathbf{103}_2$, the upstream end 107*b* of the cut-out portion 107, and the camming inner peripheral surface 100*a* of the cylinder, as shown by the arrow in the figure. Thus, refrigerant is drawn into the compression chamber A which has just started the suction stroke, at such a small rate that high negative pressure is developed in the compression chamber A. As a result, large torque Y is created and acts upon the vane $\mathbf{103}_2$ in a reverse direction to the direction of rotation of the rotor 101 to resist against the rotor rotation.

SUMMARY OF THE INVENTION

It is the object of the invention to provide a variable capacity type compressor in which refrigerant gas can be supplied into a compression chamber which has started a suction stroke at a sufficient rate during partial capacity operation, thereby reducing resistance to the rotation of the rotor during partial capacity operation.

To attain the above object, the present invention provides a variable capacity type compressor including a cylinder formed by a cam ring having a camming inner peripheral surface, and a pair of side blocks closing opposite ends of the cam ring, one of the side blocks having at least inlet port formed therein, a rotor rotatably received within the cylinder and having an outer peripheral surface, a plurality of vanes carried by the rotor, at least one compression space defined between the cylinder and the rotor, and a control element mounted in the one of the side blocks for rotation about an axis thereof in opposite circumferential directions between a first extreme position providing the maximum capacity of the compressor and a second extreme position providing the minimum capacity of the compressor, to vary the compression starting timing, the cam ring having an end face facing the control element, the control element having an outer peripheral edge thereof formed with at least one cut-out portion through which compression medium is drawn into the compression space, the cut-out portion having one end and another end being downstream and upstream relative to each other with respect to the direction of rotation of the rotor, the one end determining the compression starting timing in cooperation with each of the vanes passing the one end, the cut-out portion comprising a first portion circumferentially extending from the one end of the cut-out portion to a circumferentially intermediate portion thereof and being almost flush with the outer peripheral surface of the rotor, and a second portion circumferentially extending continuously from the first portion to the another end, the second portion being located radially outwardly of the camming inner peripheral surface of the cam ring.

The variable capacity type compressor according to the invention is characterized by an improvement comprising at least one recess formed in the end face of the cam ring facing the control element, the recess opening in the camming inner peripheral surface of the cam ring and circumferentially extending from a circumferential location at which a suction stroke is started in the compression space or from a point proximate thereto, toward a downstream side with respect to the direction of rotation of the rotor, the recess being disposed such that when the control element is in the second extreme position, the recess has a downstream end thereof with respect to the direction of rotation of the rotor positioned downstream of the another end of the cut-out portion.

More advantageously, the cut-out portion of the control element may be further formed with a third portion which circumferentially extends continuously from the second portion toward an upstream side with respect to the direction of rotation of the rotor.

Preferably, the third portion of the cut-out portion is located radially outwardly of the camming inner peripheral surface of the cam ring.

The above and other objects, features, and advantages of the invention will be more apparent from the ensuing detailed description taken in conjunction with the accompanying drawings.

DETAILED DESCRIPTION

Figure 1:
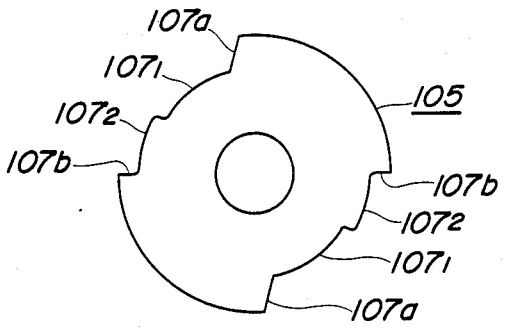
FIG. 1 PRIOR ART
FIG. 1 is a rear side view of a conventional control plate member.
Figure 2:
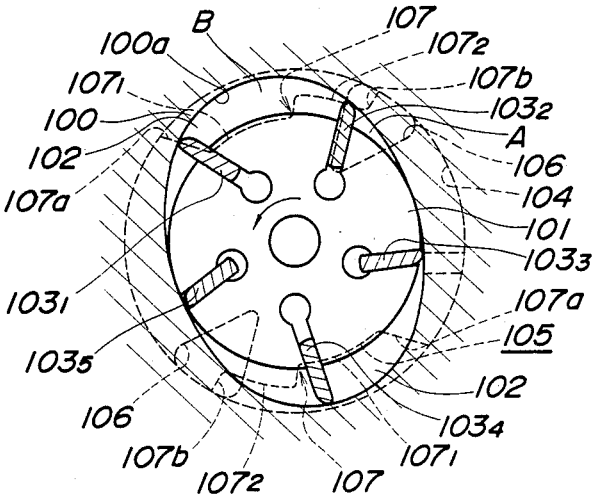
FIG. 2 PRIOR ART
FIG. 2 is a schematic transverse sectional view of essential part of a variable capacity type vane compressor using the control plate member of FIG. 1.
Figure 3:
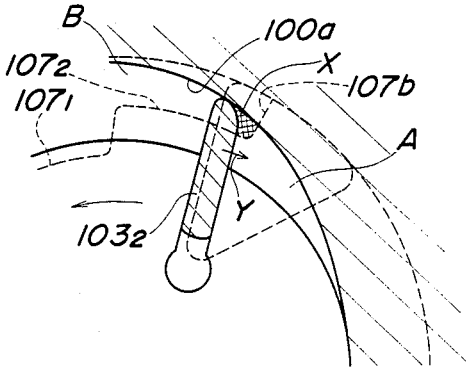
FIG. 3 PRIOR ART
FIG. 3 is a fragmentary view showing essential part of the compressor on an enlarged scale.

The invention will be described in detail with reference to FIGS. 4–15 of the drawings showing embodiments thereof. Corresponding or like elements and parts are designated by identical reference numerals throughout all the views.

Referring first to FIGS. 4–11, there is illustrated a variable capacity type vane compressor according to a first embodiment of the invention. As shown in FIGS. 4–10, the compressor is mainly composed of a cylinder formed by a cam ring 1 with an oblong camming inner peripheral surface 1*a*, and front and rear side blocks 3 and 4 closing opposite ends of the cam ring 1, a cylindrical rotor 2 rotatably received within the cylinder, front and rear heads 5 and 6 secured to outer ends of the respective side blocks 3, 4, and a drive shaft 7 on which the rotor 2 is rigidly fitted. The drive shaft 7 is rotatably supported by bearings 8 and 9 mounted, respectively, in the side blocks 3, 4.

Figure 10:
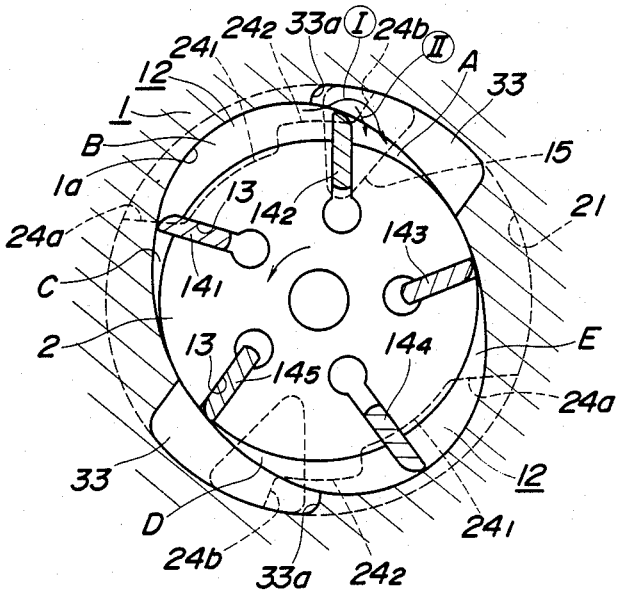
FIG. 10 is a schematic sectional view showing the positional relationship between the control plate member, inlet ports, and vanes, assumed when the control plate member is in a partial capacity operation position.

A discharge port 5*a* is formed in an upper side surface of the front head 5, while a suction port 6*a* is formed in an upper side surface of the rear head 6. The discharge port 5*a* opens into a discharge pressure chamber 10 defined between the front head 5 and the front side block 3, while the suction port 6*a* opens into a suction chamber 11 defined between the rear head 6 and the rear side block 4. Two compression spaces 12 are defined between the camming inner peripheral surface 1*a* of the cam ring 1 and the outer peripheral surface of the rotor 2 at diametrically opposite locations. The outer peripheral surface of the rotor 2 is formed with a plurality of, e.g. five, axial vane slits 13 arranged at circumferentially equal intervals, in which are radially slidably fitted vanes $14_1$–$14_5$. Adjacent vanes define therebetween five compression chambers A–E within the compression spaces 12 in cooperation with the cam ring 1, the rotor 2, and opposed inner end faces of the front and rear side blocks 3, 4 (FIG. 10).

Figure 4:
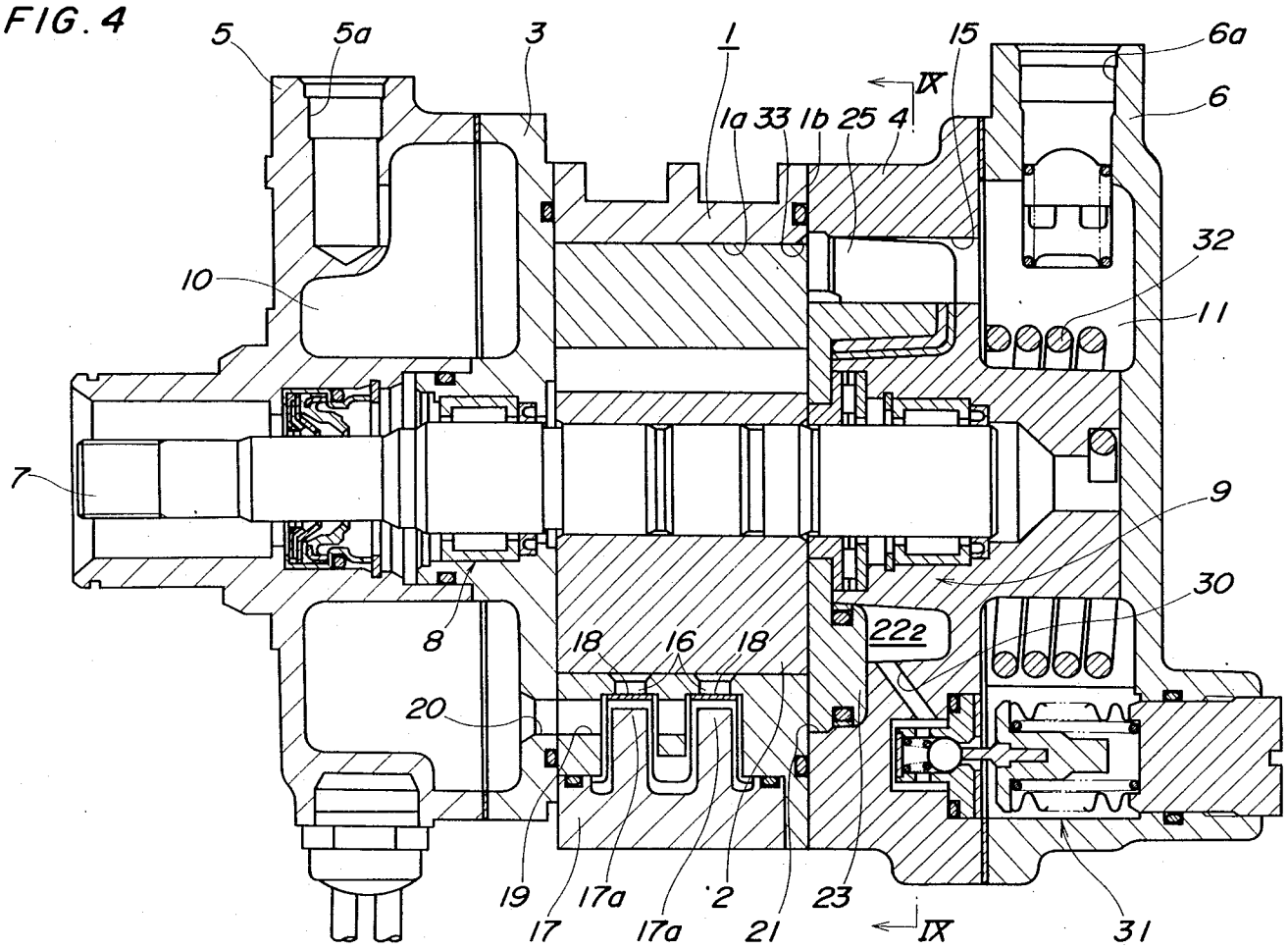
FIG. 4 is a longitudinal sectional view of a variable capacity type vane compressor according to a first embodiment of the invention, taken along a line radially extending through the axis of the drive shaft at right angles thereto.
Figure 5:
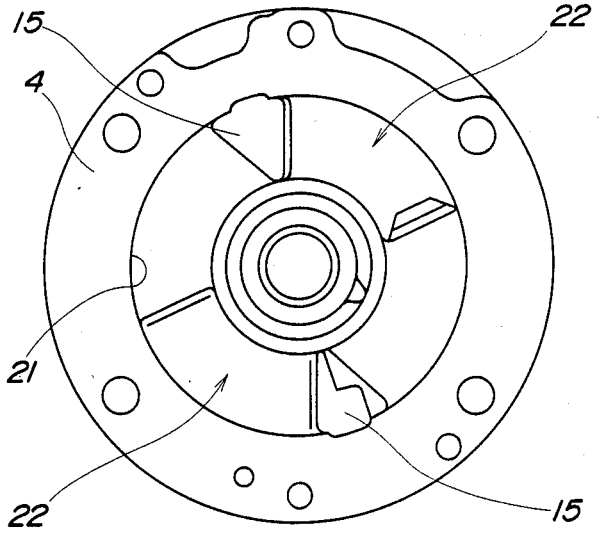
FIG. 5 is an end view of a rear side block appearing in FIG. 4.

The rear side block 4 is formed with two inlet ports 15 and 15 at diametrically opposite locations, as shown in FIGS. 4 and 5 (only of them is shown in FIG. 4 since the figure is a sectional view taken along a line radially extending through the axis of the drive shaft at right angles thereto). Each inlet port 15 axially penetrates the rear side block 4 so that the suction chamber 11 and the associated compression space 12 are communicated with each other.

The cam ring 1 has its outer peripheral wall formed with two sets of outlet ports 16 at diametrically opposite locations, each set comprising two outlet ports and only one set of which is shown in FIG. 4. At each set of the outlet ports 16, a valve cover 17 having integral valve stoppers 17*a* is secured on the outer peripheral surface of the cam ring 1, and two discharge valves 18 are arranged between the outer peripheral wall of the cam ring 1 and the valve stoppers 17*a* in a manner being retained by the valve cover 17. The discharge valves 18 are opened by discharge pressure being discharged through the outlet ports 16. The cam ring 1 and the front side block 3 are formed, respectively, with communication passages 19 and 20 continuous with each other at diametrically opposite locations. When the outlet ports 16 are opened by the discharge valves 18, compressed refrigerant gas from the compression space 12 is discharged through the outlet ports 16, and then guided to travel through the communication passages 19, 20, and the discharge pressure chamber 10, and discharged into a refrigerating circuit, not shown, of the air conditioning system, through the discharge port 5a.

Figure 7:
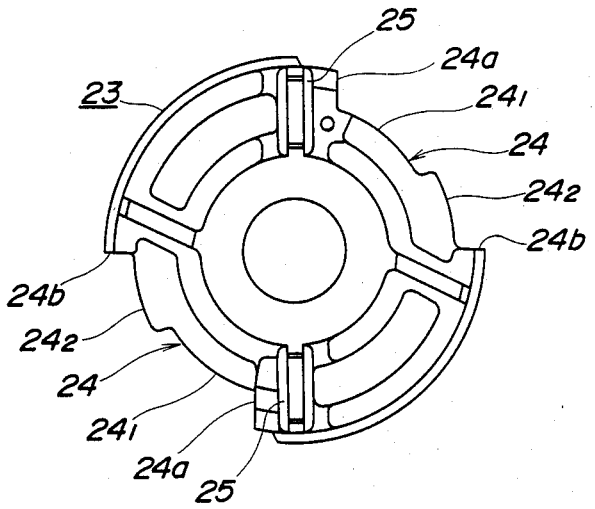
FIG. 7 is a front side view of a control plate member (control element) in FIG. 4.
Figure 8:
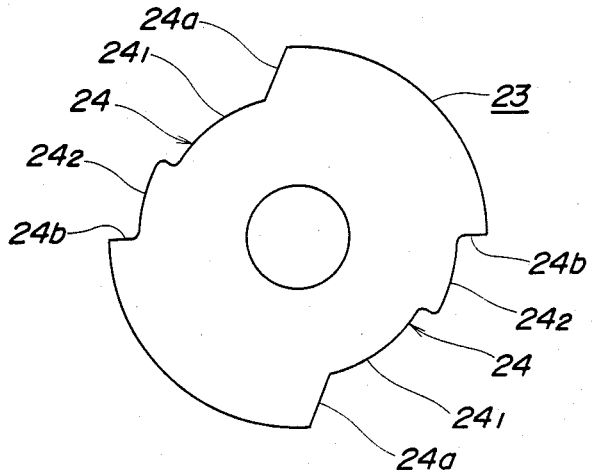
FIG. 8 is a rear side view of the control plate member.

As shown in FIG. 5, the rear side block 4 has an end facing the rotor 2 in which is formed an annular recess 21. An annular control plate member 23 is received in the annular recess 21 in a manner being fitted on the drive shaft 7, for rotation about its own axis or the axis of the drive shaft 7 in opposite circumferential directions. The control plate member 23 has a configuration as shown in FIGS. 7 and 8.

The control plate member 23 acts to vary the compression starting timing as it is rotated within the annular recess 21 in opposite circumferential directions. The control plate member 23 has its outer peripheral edge formed with a pair of diametrically opposite cut-out portions 24 and 24, each circumferentially extending over the entire rotatable angle range of the control plate member 23, and through which refrigerant gas is drawn from the inlet ports 15 into the compression spaces 12. Each cut-out portion 24 is composed of a first portion $24_1$ circumferentially extending from a downstream end of the cut-out portion 24 with respect to the direction of rotation of the rotor 2, that is, a counterclockwise extreme end thereof as viewed in FIG. 10 to an intermediate portion of same, and a second portion $24_2$ circumferentially extending from the intermediate portion to the other or upstream end 24b of the cut-out portion 24. The first portion $24_1$ is almost flush with the outer peripheral surface of the rotor 2, while the second portion $24_2$ is shallower or smaller in depth such that it is located radially outwardly of the outer peripheral surface of the rotor 2 by a predetermined amount. The second portion $24_2$ serves to allow part of the refrigerant in the compression chamber B on the suction stroke (FIG. 10) to leak into a zone under lower pressure, e.g. the suction chamber through the inlet port 15 during minimum capacity operation to eliminate unnecessary compression and hence reduce resistance of the compressed gas against the rotation of the rotor, as disclosed in U.S. Ser. No. 196,318, assigned to the assignee of the present application. Since the second portion $24_2$ is located radially outwardly of the level of the rotor outer peripheral surface, leakage of refrigerant gas can be avoided, which would occur when the control plate member 23 is in a full capacity position in FIG. 11, if the second portion $24_2$ is too close to the outer peripheral surface la of the cam ring 1.

Figure 9:
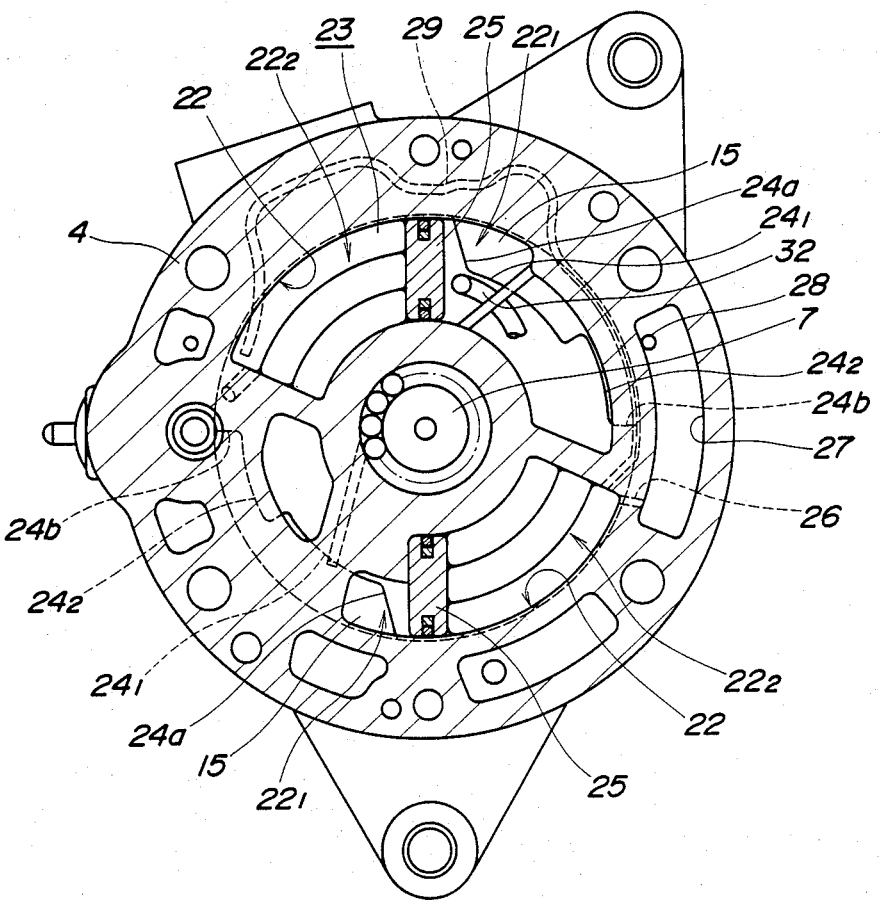
FIG. 9 is a transverse sectional view taken along line IX—IX in FIG. 4.

The control plate member 23 has one side surface thereof formed integrally with a pair of pressure-receiving protuberances 25 and 25 at circumferentially opposite locations. As shown in FIG. 9, each protuberance 25 is slidably fitted in an associated one of two pressure chambers 22 and 22 formed in the annular recess 21 in the rear side block 4 such that the pressure chamber 22 is divided into a lower pressure chamber $22_1$ and a higher pressure chamber $22_2$, the former communicating with the suction chamber 11 via the corresponding inlet port 15 to be supplied with suction pressure or low pressure PS therefrom. One of the higher pressure chambers $22_2$, $22_2$ communicates with the aforementioned communication passage 20 formed in the front side block 3 via a restriction passage 26 and a communication passage 27, both formed in the rear side block 4, and a control pressure supply port 28 formed in the cam ring 1, as shown in FIG. 9. The two higher pressure chambers $22_2$, $22_2$ are communicated with each other by means of a communication passage 29 formed in the rear head 6. Therefore, when the outlet ports 16 are opened, high pressure refrigerant gas from the compression chamber 12 is discharged through the open outlet ports 16, and part of the discharged high pressure refrigerant gas is then guided through the communication passages 19, 20, control pressure-supply port 28, communication passage 27, and restriction passage 26 into the above one higher pressure chamber $22_2$. Further, part of the refrigerant gas introduced into the one higher pressure chamber $22_2$ is guided through the communication passage 29 into the other higher pressure chamber $22_2$ so that control pressure $P_C$ is created within the two chambers $22_2$, $22_2$.

Further, as shown in FIG. 4, another communication passage 30 is formed in the rear side block 4, across which is arranged a control valve device 31 to selectively cause one of the higher pressure chambers $22_2$, $22_2$ to communicate with suction chamber 11 therethrough. The control valve device 31 operates in response to suction pressure $P_S$ within the suction chamber 11 to control the control pressure $P_C$ within the higher pressure $22_2$. More specifically, when the suction pressure $P_S$ is higher than a predetermined value, it is closed to maintain the control pressure $P_C$ at a higher level, while when the suction pressure $P_S$ is below the predetermined value, it is open to allow the control pressure $P_C$ to leak into the suction chamber 11.

Figure 11:
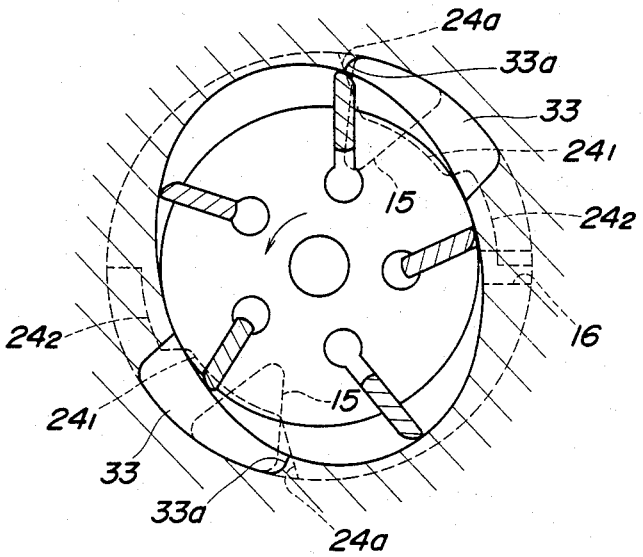
FIG. 11 is a similar view to Fi. 10, showing the positional relationship assumed when the control plate member is in a full capacity position.
Figure 12:
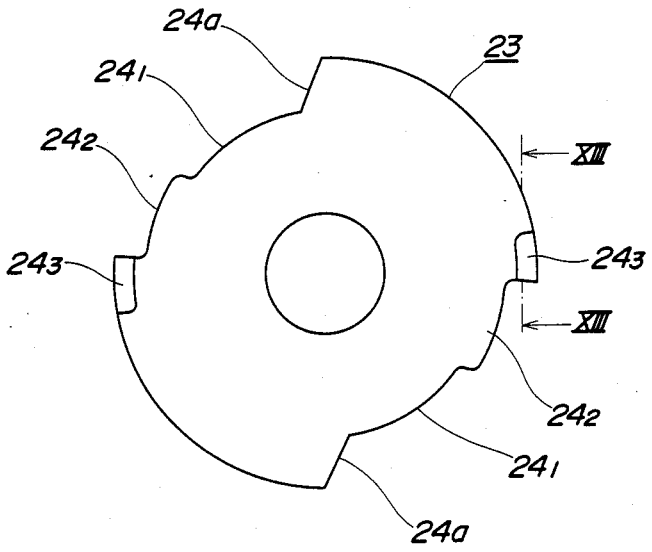
FIG. 12 is a rear side view of a control plate member used in a variable capacity type vane compressor according to a second embodiment of the invention.

The control plate member 23 is circumferentially urged by a torsional coiled spring 32 (FIG. 4) in a counterclockwise direction as viewed in FIG. 9. Thus, the control plate member 23 is rotated in opposite circumferential directions in response to the difference between the sum of the suction pressure $P_S$ introduced into the lower pressure chambers $22_1$ and the urging force of the torsional coiled spring 32 and the control pressure $P_C$ within the higher pressure chambers $22_2$, $22_2$. That is, the control pressure $P_C$ within the higher pressure chambers $22_2$, $22_2$ is controlled by the action of the control valve device 31 so that the suction pressure $P_S$ becomes equal to a predetermined value whereby the control plate member 23 is circumferentially displaced between a first extreme position or full capacity position where the maximum capacity of the compressor is obtained as shown in FIG. 11 and a second extreme position or partial capacity position where the minimum capacity is obtained as shown in FIG. 10.

Figure 6:
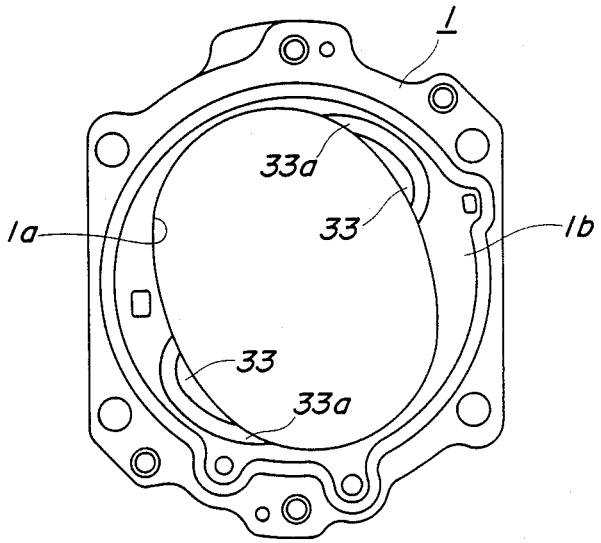
FIG. 6 is an end view of a cam ring appearing in FIG. 4.

An end face of the cam ring 1 facing the control plate member 23 is formed with a pair of recesses or 33, preferably formed of chamfers, at diametrically opposite locations, each recess opening in the camming inner peripheral surface 1a of the cam ring 1 and circumferentially extending from a circumferential location at which the suction stroke commences in the compression space 12 or from a point proximate thereto toward downstream side with respect to the direction of rotation of the rotor 2, as shown in FIGS. 4 and 6. Each recess or chamfer 33 is disposed such that when the control plate member 23 is in the partial capacity operation position as shown in FIG. 10, the recess 33 has a downstream end 33a thereof with respect to the direction of rotation of the rotor positioned downstream of the upstream end 24b of the cut-out portion 24.

The operation of the variable capacity type vane compressor according to the invention constructed as above will now be explained.

In each compression space 12, the compression chamber on the suction stroke, which is defined between adjacent vanes, e.g. $14_1$, $14_2$, is supplied with refrigerant gas from the suction chamber 11 through the inlet port 15 and the cut-out portion 24 of the control plate member 23. Then, when the upstream one of the two vanes $14_1$, $14_2$ passages the downstream end 24*a* of the cut-out portion 24 so that the compression chamber defined by the vanes $14_1$, $14_2$ becomes disconnected from the inlet port 15, compression is started. The compression starting timing becomes retarded as the control plate member 23 is circumferentially displaced from the full capacity position shown in FIG. 11 toward the partial capacity position shown in FIG. 10, whereby the delivery quantity or capacity is continuously decreased. In other words, when the control plate member 23 is in the partial capacity position, the downstream end 24*a* of the cut-out portion 24 is positioned in the downstream extreme position in the direction of rotation of the rotor 2 and accordingly the compression is started at the latest timing. Consequently, the volume of refrigerant gas trapped between the two adjacent vanes is the minimum and hence the delivery quantity is the minimum. On the other hand, when the control plate member 23 is in the full capacity position, the downstream end 24*a* of the cut-out portion 24 is positioned in the upstream extreme position in the direction of rotation of the rotor to obtain the earliest compression starting timing so that the volume of refrigerant gas trapped between the two adjacent vanes is the maximum and hence the delivery quantity is the maximum.

Reference is now made to the manner in which refrigerant gas is supplied into the compression chamber which has entered or started the suction stroke. When the control plate member 23 is in the partial capacity position as shown in FIG. 10, the compression chamber A defined between adjacent vanes $14_2$, $14_3$ entering the suction stroke is supplied with refrigerant gas which leaks from the immediately preceding compression chamber B and travels through a path I defined between the tip of the vane $14_2$ and the recess or chamfer 33 in the cam ring 1, as well as with refrigerant gas from the inlet port 15 travelling through a path II defined between the trailing side surface of the vane $14_2$, the upstream end 24*b* of the cut-out portion 24, and the recess 33. Therefore, refrigerant gas can be supplied into the compression chamber A at a sufficient rate so that high negative pressure is prevented from occurring in the compression chamber A to thereby reduce torque acting upon the vane $14_2$ in the reverse direction to the direction of rotation of the rotor 2 and hence reduce the resistance against the rotor rotation.

Figure 13:
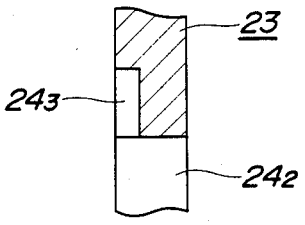
FIG. 13 is a fragmentary sectional view taken along line XIII—XIII in FIG. 12.

FIGS. 12 through 15 illustrate a second embodiment of the invention. According to this embodiment, the cut-out portion 24 is further formed with a third portion $24_3$ extending continuously from a second cut-out portion $24_2$ toward an upstream side with respect to the direction of rotation of the rotor. Except for this, the second embodiment is identical with the first embodiment described above. The third portion $24_3$ of the cut-out portion 24 is shallower or smaller in depth than the second portion $24_2$ and located radially outwardly thereof, and may preferably be in the form of a groove as shown in FIG. 13, with a depth of the order of 2 mm, for example.

Figure 14:
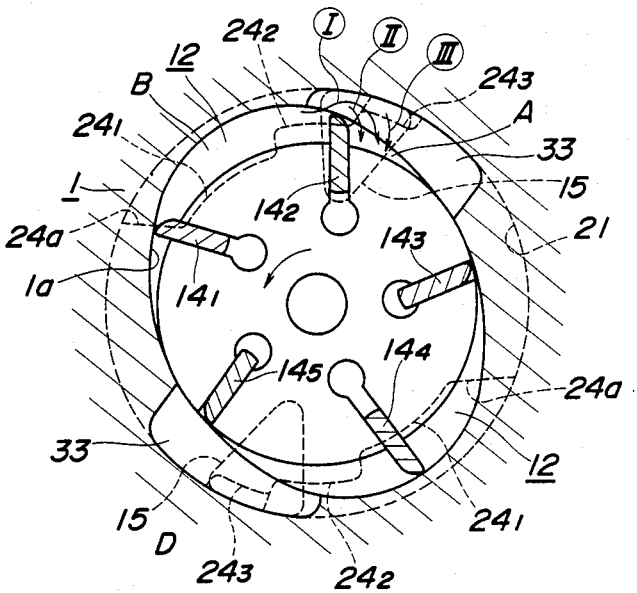
FIG. 14 is a similar view to FIG. 10, showing the positional relationship assumed when the control plate member in FIG. 12 is in a partial capacity position.
Figure 15:
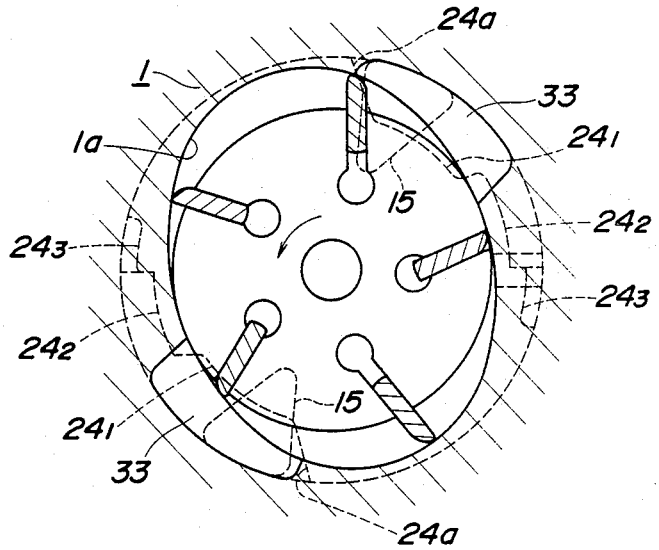
FIG. 15 is a similar view to FIG. 10, showing the positional relationship assumed when the control plate member in FIG. 12 is in a full capacity position.

According to the second embodiment, when the control plate member 23 is in the partial capacity position as shown in FIG. 14, the compression chamber A defined between vanes $14_2$, $14_3$ entering the suction stroke is supplied with refrigerant gas not only through the passages I and II described before with reference to FIG. 10, but also through a passage III defined between the third portion $24_3$ and the recess or chamfer 33. Furthermore, since the third portion $24_3$ is always located radially outwardly of the second portion $24_2$, i.e., radially outwardly of the camming inner peripheral surface la of the cam ring 1 irrespective of the circumferential position of the control plate member 23 so that the path III is not varied in sectional area by the movement of the vane. Thus, the compression chamber A can be supplied with a more sufficient amount of refrigerant gas than the first embodiment to further positively prevent development of high negative pressure in the compression chamber A and hence further reduce torque reversely acting upon the vane $14_2$ and hence the resistance against the rotor rotation.

What is claimed is:

1. In a variable capacity type compressor including a cylinder formed by a cam ring having a camming inner peripheral surface, and a pair of side blocks closing opposite ends of said cam ring, one of said side blocks having at least one inlet port formed therein, a rotor rotatably received within said cylinder and having an outer peripheral surface, a plurality of vanes carried by said rotor, at least one compression space defined between said cylinder and said rotor, and a control element mounted in said one of said side blocks for rotation about an axis thereof in opposite circumferential directions between a first extreme position providing the maximum capacity of the compressor and a second extreme position providing the minimum capacity of the compressor, to vary the compression starting timing, said cam ring having an end face facing said control element, said control element having an outer peripheral edge thereof formed with at least one cut-out portion through which compression medium is drawn into said compression space, said cut-out portion having one end and another end being downstream and upstream relative to each other with respect to the direction of rotation of said rotor, said one end determining the compression starting timing in cooperation with each of said vanes passing said one end, said cut-out portion comprising a first portion circumferentially extending from said one end of said cut-out portion to a circumferentially intermediate portion thereof and being almost flush with said outer peripheral surface of said rotor, and a second portion circumferentially extending continuously from said first portion to said another end, said second portion being located radially outwardly of said camming inner peripheral surface of said cam ring, the improvement comprising at least one recess formed in said end face of said cam ring facing said control element, said recess opening in said camming inner peripheral surface of said cam ring and circumferentially extending from a circumferential location at which a suction stroke is started in said compression space or from a point proximate thereto, toward a downstream side with respect to the direction of rotation of said rotor, said recess being disposed such that when said control element is in said second extreme position, said recess has a downstream end thereof with respect to the direction of rotation of said rotor positioned downstream of said another end of said cut-out portion.

2. In a variable capacity type compressor including a cylinder formed by a cam ring having a camming inner peripheral surface, and a pair of side blocks closing opposite ends of said cam ring, one of said side blocks having at least one inlet port formed therein, a rotor rotatably received within said cylinder and having an outer peripheral surface, a plurality of vanes carried by said rotor, at least one compression/space defined between said cylinder and said rotor, and a control element mounted in said one of said side blocks for rotation about an axis thereof in opposite circumferential directions between a first extreme position providing the maximum capacity of the compressor and a second extreme position providing the minimum capacity of the compressor, to vary the compression starting timing, said cam ring having an end face facing said control element, said control element having an outer peripheral edge thereof formed with at least one cut-out portion through which compression medium is drawn into said compression space, said cut-out portion having one end and another end being downstream and upstream relative to each other with respect to the direction of rotation of said rotor, said one end determining the compression starting timing in cooperation with each of said vanes passing said one end, said cut-out portion comprising a first portion circumferentially extending from said one end of said cut-out portion to a circumferentially intermediate portion thereof and being almost flush with said outer peripheral surface of said rotor, and a second portion circumferentially extending continuously from said first portion to said another end, said second portion being located radially outwardly of said camming inner peripheral surface of said cam ring, the improvement comprising:

at least one recess formed in said end face of said cam ring facing said control element, said recess opening in said camming inner peripheral surface of said cam ring and circumferentially extending from a circumferential location at which a suction stroke is started in said compression space or from a point proximate thereto, toward a downstream side with respect to the direction of rotation of said rotor, said recess being disposed such that when said control element is in said second extreme position, said recess has a downstream end thereof with respect to the direction of rotation of said rotor positioned downstream of said another end of said cut-out portion;

wherein said cut-out portion of said control element is further formed with a third portion, said third portion circumferentially extending continuously from said second portion toward an upstream side with respect to the direction of rotation of said rotor.

3. A variable capacity type compressor as claimed in claim 2, wherein said third portion of said cut-out portion is located radially outwardly of said camming inner peripheral surface of said cam ring.

4. A variable capacity type compressor as claimed in claim 2, wherein said third portion of said cut-out portion is smaller in depth than said second portion.

5. A variable capacity type compressor as claimed in claim 3, wherein said second portion of said cut-out portion is located radially inwardly of said camming inner peripheral surface of said cam ring.

* * * * *